US006058746A

United States Patent [19]

Mirshafiee et al.

[11] Patent Number: 6,058,746

[45] Date of Patent: May 9, 2000

[54] ADJUSTABLE INTERCONNECTED LOCK

[75] Inventors: David Mirshafiee, Fountain Valley; Gary Bergen, Yorba Linda, both of Calif.

[73] Assignee: Emhart Inc., Newark, Del.

[21] Appl. No.: 09/130,987

[22] Filed: Aug. 7, 1998

[51] Int. Cl.[7] ..... E05B 59/00

[52] U.S. Cl. ..... 70/107; 70/370; 70/451; 70/461; 292/39; 292/DIG. 60; 292/DIG. 64

[58] Field of Search ..... 70/107, 461, 370, 70/451, 466; 292/39, DIG. 53, DIG. 60, DIG. 64

[56] References Cited

U.S. PATENT DOCUMENTS

| | | | |
|---|---|---|---|
| 897,686 | 9/1908 | Voight | 70/451 |
| 3,254,518 | 6/1966 | Tucker | 70/107 |
| 3,791,180 | 2/1974 | Doyle | 70/107 |
| 3,910,613 | 10/1975 | Nolin | 70/107 X |
| 3,999,789 | 12/1976 | Maurits et al. | 70/107 X |
| 4,129,019 | 12/1978 | Urdal | 70/107 |
| 4,276,760 | 7/1981 | Nolin | 70/107 |
| 4,838,053 | 6/1989 | Shen | 292/336.3 X |
| 4,979,767 | 12/1990 | Lin | 292/336.3 |
| 5,457,975 | 10/1995 | Berger et al. | 70/370 |
| 5,496,082 | 3/1996 | Zuckerman | 292/336.3 |
| 5,513,505 | 5/1996 | Dancs | 70/107 |
| 5,655,393 | 8/1997 | Kuo et al. | 70/107 |
| 5,657,653 | 8/1997 | Hensley et al. | 70/107 X |
| 5,713,612 | 2/1998 | Kajuch | 292/36 |
| 5,787,741 | 8/1998 | Shen | 70/107 |
| 5,810,402 | 9/1998 | Armstrong | 292/39 |

FOREIGN PATENT DOCUMENTS

| | | | |
|---|---|---|---|
| 2026582 | 12/1971 | Germany | 70/461 |

*Primary Examiner*—Lloyd A. Gall
*Attorney, Agent, or Firm*—Charles E. Yocum; John D. Del Ponti

[57] ABSTRACT

An adjustable interconnected lockset adapted to be secured to a door which includes a mounting plate assembly having a vertically extending mounting plate having an operator bracket proximate the bottom thereof with the operator bracket having screw receiving holes. The lockset also has an exterior operator assembly including internally threaded posts, first screw holes extending through the mounting plate and screws which extend through the mounting plate and threadedly engaging with the threaded posts to clamp the door between the exterior operator assembly and the mounting plate assembly. The mounting plate has a central opening extending vertically upwardly from a location proximate the operator bracket and defining mounting plate side panels on either side thereof and the mounting plate assembly further has a dead bolt bracket which includes a central door engaging portion, a pair of opposed side portions adapted to engage the mounting plate side panels, and screw receiving holes. An exterior dead bolt assembly includes internally threaded posts and second screws extend through dead bolt bracket screw receiving holes and threadedly engage with the exterior dead bolt internally threaded posts to clamp the door between the exterior dead bolt assembly and the mounting plate assembly.

1 Claim, 1 Drawing Sheet

ADJUSTABLE INTERCONNECTED LOCK

BACKGROUND OF THE INVENTION

The present invention relates to locks which have an upper deadbolt (auxiliary lock) and a lower lock which are interconnected. The interconnection is to provide a panic feature, i.e., when the operator (the knob or lever) of the interior lower lock is turned, the upper deadbolt will be automatically released.

U.S. Ser. No. 08/694,978, filed Aug. 9, 1996, now U.S. Pat. No. 5,810,402 discloses an adjustable interconnected lock which enables interconnection of an exterior assembly that has one spacing between the deadbolt and the thumb piece and an interior assembly that has a different spacing between the turn button and the interior operator.

OBJECT OF THE INVENTION

It is an object of the present invention to provide an adjustable interconnected lock which is more user friendly than prior art designs.

Other objects and advantages of the present invention will become apparent from the following portion of this specification and from the accompanying drawings which illustrate in accordance with the mandate of the patent statutes a presently preferred embodiment incorporating the principles of the invention.

BRIEF DESCRIPTION OF THE PREFERRED EMBODIMENT

Figure 1:
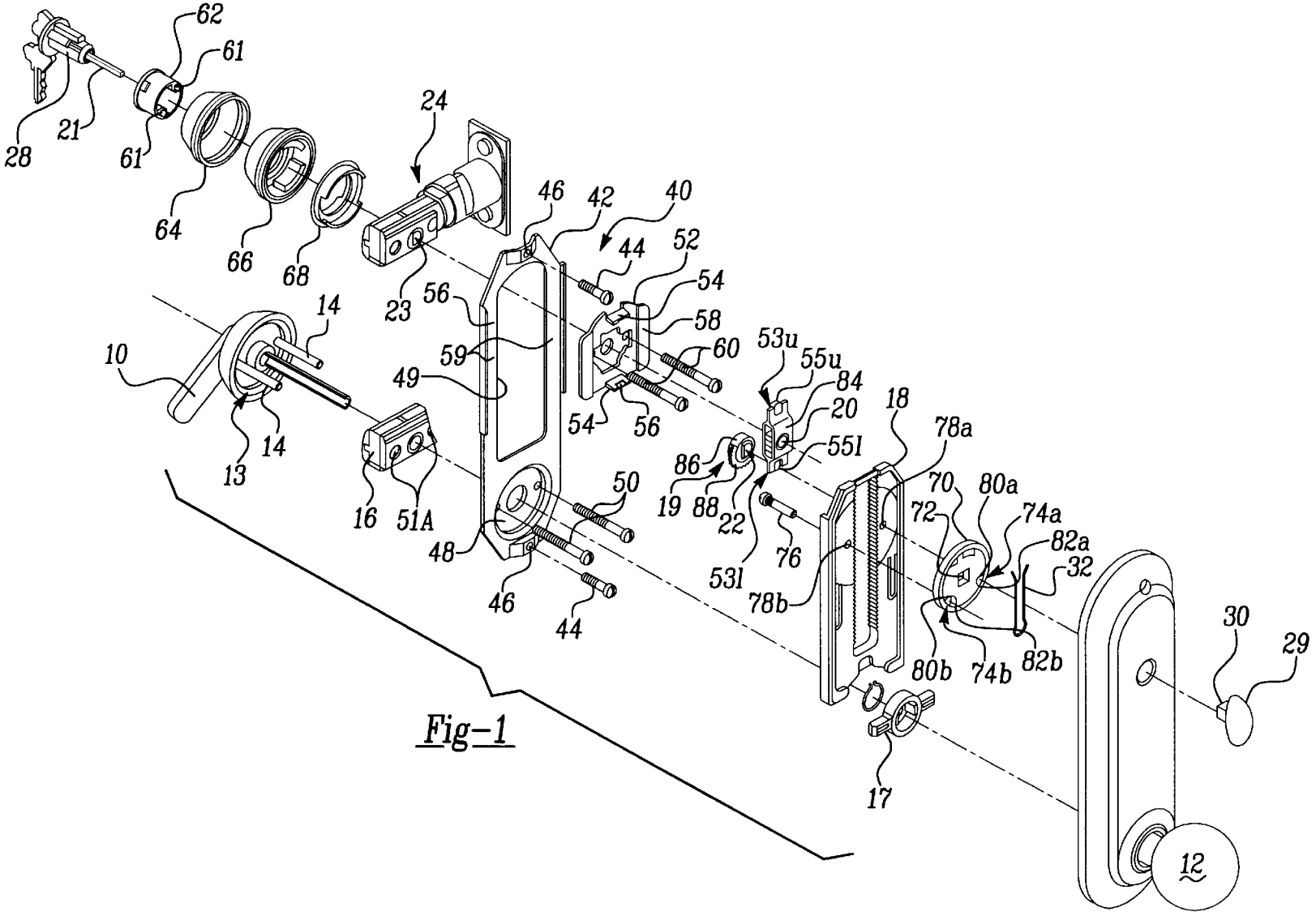
FIG. 1 is an exploded oblique view of an interconnected lock made in accordance with the teachings of the present invention.

When a door (not shown) is unlocked, the exterior operator 10 (here a lever) and the interior operator 12 (here a knob) operate together and when the door is locked the exterior operator can not be turned but the interior operator is free to turn. The structure which allows the operators to operate in this fashion is conventional and accordingly most is omitted from this description for purposes of clarity (U.S. Pat. Nos. 5,317,889 and 5,496,082 disclose such details and are incorporated by reference herein). The exterior operator assembly, which includes the lever 10, the liner 13 which has two posts 14 which are internally threaded at their ends, and a half round assembly 15, is shown as is the latch 16 which is operated by the half round assembly.

The turning of an operator, which is free to turn, rotates a lower axis cam 17 which elevates a rack 18 to drive a pinion 19 located within a housing 20. A D-shaped spindle 21, which is received by a D-shaped opening 22 in the pinion and by a D-shaped opening 23 in a dead latch assembly 24, operates the dead latch assembly 24 drawing the dead bolt back to its withdrawn position when the pinion is rotated through a selected angle (by turning an operator from its neutral position through that angle). The D-shaped spindle interconnects a key or motor operated cylinder assembly 28 at the front of the door with a turn button 29 on the interior. The turn button has a square section 30 which cooperates with a spring 32 which is captured in suitable supports (not shown) on the inner face of the rose 34 to maintain the turn button at either of two 90° related open and closed orientations (detent orientations).

To achieve adjustability to accommodate different spacings between the upper axis defined by the turn button and the key cylinder and the lower axis defined by the interior and exterior operators, a two piece mounting plate assembly 40 is utilized. One piece, the mounting plate 42, is secured to the interior surface of the door (not shown) by screws 44 which pass through suitable holes 46 in the mounting plate. The mounting plate is conventionally a solid plate including deadbolt and operator brackets at either end. Here the mounting plate only includes an exterior operator bracket 48 at its lower end which is located within the door through hole and has a central opening 49 which extends vertically from a location above the exterior operator bracket to a location short of the top of the mounting plate. A pair of screws 50 pass through suitable holes 51 in the operator bracket, through holes 51A in the latch assembly and are threaded into the internally threaded liner posts 14 thereby securing the exterior operator to the door.

The second piece of the mounting plate assembly 40 is a reinforcing plate in the form of a slide 52 which supports the pinion housing 20. The housing, which is made of plastic, has a pair of, upper vertically extending struts 53*u* a pair of lower vertically extending struts 53*l* which locate the housing between upper and lower flanges 54 of the slide and intermediate slightly longer upper and lower central struts 55 which are received by suitable openings 56 in the flanges to secure the housing in place. The slide is located anywhere along the vertically extending opening 49 where the upper axis door hole has been drilled to receive the D-shaped spindle 21 and is secured in position with the vertically extending opposed ears 58 of the slide clamped against the side panels 59 of the mounting plate by a pair of screws 60 which are received by internally threaded posts 61 on the dead bolt cylinder housing 62 (the rest of the dead bolt is defined by a cover 64, a liner 66 and a guard 68).

To effect vertical displacement of the rack with rotation of either the turn button or the key, an upper axis cam 70 having a square opening 72 is located on the square end 30 of the turn button so that it will turn with the turn button (the end of the turn button also has a D-shaped hole (not shown) for operatively receiving the D-shaped spindle). This cam 70 has left hand and right hand control openings 74*a* and 74*b*, respectively, one of which will receive the non threaded end of a screw 76 which is threadedly inserted into the corresponding left hand or right hand hole 78*a* and 78*b*, respectively defined in the sides of the rack. These control openings are configured so that the screw will engage the top surface 80*a* or 80*b* of the respective right and left hand control openings 74 and 74*b* when the turn button is in the locked position. As the turn button is rotated to unlock the door, the upper axis cam will accordingly be rotated such that the bottom surface 82*a* or 82*b* of the right and left hand control openings 74*a* and 74*b* engage screw 76 to drive the screw to raise the rack 18. As the rack rises, the meshed engagement of the pinion 19 with the rack teeth causes the pinion and spindle 21 to rotate and move the dead bolt latch assembly to its withdrawn position. The rest of the right and left hand control openings 74*a* and 74*b* are configured so that the screw will be engaging the respective bottom most surface 82*a* or 82*b* when the turn button is at the unlocked position so that when the turn button is again rotated to advance the latch bolt, rotation of the control cam will simultaneously occur.

To switch the adjustable interconnected lock from one hand to the other, such as from the left hand configuration shown in FIG. 1 to right hand operation, the pinion housing 20 is removed and reversed from the first position illustrated to a second position relative to the slide wherein the pinion housing face 84 faces slide 52 and the rack screw is removed from left hand control opening 74*b* and left hand hole 78*b* and inserted into the rack hole right hand 78*a* so that it will be received by the control opening 74*a*. As is illustrated, the pinion 19 includes a smooth circumferential section 86 and a toothed circumferential section 88. The toothed section is sized to allow rotation of the pinion to a released position wherein the pinion teeth do not engage the rack teeth whereupon the pinion may be easily removed from the rack and the pinion housing reversed as described above.

We claim:

1. An adjustable interconnected lockset adapted to be secured to a door comprising a mounting plate assembly including a vertically extending mounting plate having an operator bracket proximate the bottom thereof, said operator bracket having screw receiving hole means, an exterior operator assembly including internally threaded post means, first screw means for extending through said mounting plate screw receiving hole means and threadedly engaging with said threaded post means to clamp the door between said exterior operator assembly and said mounting plate assembly, said mounting plate having a central opening extending vertically upwardly from a location proximate said operator bracket and defining mounting plate side panels on either side thereof, said mounting plate assembly further comprising a dead bolt bracket including a central portion disposed in said central opening, a pair of opposed side portions adapted to engage said mounting plate side panels, and screw receiving hole means, an exterior dead bolt assembly including internally threaded post means, and second screw means for extending through said dead bolt bracket screw receiving hole means and threadedly engaging with said exterior dead bolt internally threaded post means to clamp the door between said exterior dead bolt assembly and said mounting plate assembly.

* * * * *